US008831258B2

(12) United States Patent
Dressler

(10) Patent No.: US 8,831,258 B2
(45) Date of Patent: Sep. 9, 2014

(54) METHOD FOR RESTRICTING THE OUTPUT LEVEL IN HEARING APPARATUSES

(71) Applicant: Siemens Medical Instruments Pte. Ltd., Singapore (SG)

(72) Inventor: Oliver Dressler, Fuerth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/857,298

(22) Filed: Apr. 5, 2013

(65) Prior Publication Data

US 2013/0266166 A1 Oct. 10, 2013

Related U.S. Application Data

(60) Provisional application No. 61/620,507, filed on Apr. 5, 2012.

(51) Int. Cl.
*H04R 25/00* (2006.01)

(52) U.S. Cl.
USPC ..... 381/321; 381/312

(58) Field of Classification Search
CPC ..... H04R 25/00
USPC ..... 381/312, 316, 320, 321
See application file for complete search history.

(56) References Cited

U.S. PATENT DOCUMENTS 8,160,274 B2 * 4/2012 Bongiovi ..... 381/321
8,213,653 B2 * 7/2012 Von Buol et al. ..... 381/321
8,249,861 B2 * 8/2012 Li et al. ..... 381/321

FOREIGN PATENT DOCUMENTS

DE 10 2010 022 632 A1 8/2011

OTHER PUBLICATIONS

Fastl, H., et al., "Psychoacoustics—Facts and Models", Apr. 14, 1999, pp. 293-313, Springer, Berlin Heidelberg New York.
Dillon, "Hearing Aids Figures for Chapter 5—Earmolds and earshells", 2001, URL: www.boomerangpress.com.au/HearAids5.ppt.
IEC International Standard, "Electroacoustics—Hearing aids—Part 7: Measurement of the performance characteristics of hearing aids for production, supply and delivery quality assurance purposes", 2005, Second edition.

* cited by examiner

*Primary Examiner* — Suhan Ni
(74) *Attorney, Agent, or Firm* — Laurence A. Greenberg; Werner H. Stemer; Ralph E. Locher

(57) ABSTRACT

Psychoacoustic boundary conditions are to be better taken into account in the amplification of input signals of a hearing apparatus. To this end, a channel-specific compression characteristic curve is predetermined in a number of spectrally-separated processing channels of the hearing apparatus, which defines a relationship between an input level and an output level in the respective processing channel of the hearing apparatus. A respective input signal portion is amplified in each processing channel as a function of a channel-specific operating compression characteristic curve. A channel-specific input level threshold is predefined here for each processing channel. Finally, the respective channel-specific operating compression characteristic curve is then defined according to the predetermined channel-specific compression characteristic curve below the channel-specific input level threshold and the respective curve of the channel-specific operating compression characteristic curve is defined with a compression ratio of greater than 8 above the channel-specific input level threshold.

9 Claims, 2 Drawing Sheets

METHOD FOR RESTRICTING THE OUTPUT LEVEL IN HEARING APPARATUSES

CROSS-REFERENCE TO RELATED APPLICATION

This application claims the priority, under 35 U.S.C. §119 (e), of provisional patent application No. U.S. 61/620,507 filed Apr. 5, 2012; the prior application is herewith incorporated by reference in its entirety.

BACKGROUND OF THE INVENTION

Field of the Invention

The present invention relates to a method for amplifying an input signal in a hearing apparatus by predefining each channel-specific compression characteristic curve in a plurality of spectrally-separated processing channels of the hearing apparatus, which defines a relationship between an input level and an output level in the respective processing channel of the hearing apparatus and amplifying a respective input signal portion of the hearing apparatus in each processing channel as a function of a channel-specific operating compression characteristic curve. The term "hearing apparatus" is understood here to mean any auditory stimulus-producing device which can be worn in or on the ear, in particular a hearing device, a headset, earphones or the like.

Hearing devices are wearable hearing apparatuses which are used to provide hearing assistance to the hard-of-hearing. In order to accommodate the numerous individual requirements, various designs of hearing devices are available such as behind-the-ear (BTE) hearing devices, hearing devices with an external earpiece (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. With these devices the damaged hearing is stimulated either mechanically or electrically.

The key components of hearing devices are principally an input transducer, an amplifier and an output transducer. The input transducer is normally a sound transducer e.g. a microphone and/or an electromagnetic receiver, e.g. an induction coil. The output transducer is most frequently realized as an electro-acoustic transducer, e.g. a miniature loudspeaker, or as an electromechanical transducer, e.g. a bone conduction receiver. The amplifier is usually integrated into a signal processing unit. This basic configuration is illustrated in FIG. 1 using the example of a behind-the-ear hearing device. One or more microphones 2 for picking up ambient sound are incorporated into a hearing device housing 1 to be worn behind the ear. A signal processing unit (SPU) 3 which is also integrated into the hearing device housing 1 processes and amplifies the microphone signals. The output signal from the signal processing unit 3 is transmitted to a loudspeaker or receiver 4, which outputs an acoustic signal. The sound may be transmitted to the device wearer's eardrum by way of an acoustic tube which is fixed in the auditory canal by means of an earmold. Power for the hearing device and in particular for the signal processing unit 3 is supplied by means of a battery (BAT) 5 which is also integrated in the hearing device housing 1.

The performance of a hearing device is by standard (see IEC 60118-7:2005) determined by the achievable output sound pressure level at an input level of 90 dB SPL (Sound Pressure Level). The so-called OSPL 90 reproduction curve resulting therefrom must be adjusted optimally in order on the one hand to prevent an excessively loud output level and excessive distortions of the output signal and on the other hand to rule out the operation in the saturation range of the receiver in the event of inadequate speech intelligibility.

Two methods of restricting the maximum output sound pressure level are generally available, such as described in H. Dillon in "Hearing Aids," Turramurra, Australia, Boomerang Press (2001). On the one hand, so-called "peak clipping" cuts off signal peaks. Alternatively, an output level-controlled dynamic compression (compression limiting) can be implemented with a high compression rate, which shows the relationship between the input level range and the output level range. In most instances, the output level-controlled dynamic compression is used. The signal peaks are only cut off in hearing devices covering very significant hearing losses.

All of the methods have in common the comparison of the output sound pressure level with a specific level threshold. The respective restriction algorithms are then effective if this level threshold is exceeded. For restriction by way of output level-controlled dynamic compression, both a frequency-dependent and also a frequency-independent level threshold can be predetermined. The achievable maximum output sound pressure level is optimized in individual frequency ranges with the suitable selection of frequency-dependent level thresholds.

Signal processing in digital hearing devices is usually effected in a plurality (e.g., 48 or 64) of channels. A specific frequency band is assigned to each of these channels. An input signal portion is then processed in each of the channels in a frequency-dependent and/or channel-specific manner.

The frequency-dependent and/or channel-specific level thresholds (converted into the frequency bands of the respective channel signal processing) for the restriction generally lie below a frequency-independent, i.e. broadband level threshold, to which the broadband overall level of the output signal is related. Aside from the channel-specific output level restriction, the broadband output level restriction can also take effect, which is applied in the signal flow after the frequency-dependent and/or channel-specific level restriction. As a result, narrowband signals (e.g. pure tones) in a lower broadband level are however restricted as broadband (e.g. low-noise) signals. This results in only the frequency-independent level threshold being effective for very loud broadband input signals. The distortions associated therewith are very bothersome in the case of loud signals.

It is further known, assuming the same loudness, that the level of a narrowband signal has to be higher than the level of a broadband signal. Therefore, a pure sinusoid signal at the frequency 1 kHz with the level 78 dB SPL, for instance, is equally as loud as a uniformly excited noise with the level of 60 dB SPL, as described by E. Zwicker and H. Fastl in "Psychoacoustics, Facts and Models", Springer (1999). This is contrary to the above behavior in an output level restriction by dynamic compression with fixed frequency-dependent thresholds for the output level. This restriction then renders the loudness of a broadband signal significantly higher than that of a narrowband signal.

SUMMARY OF THE INVENTION

It is accordingly an object of the invention to provide a method for amplifying an input signal in a hearing apparatus which overcomes the above-mentioned disadvantages of the heretofore-known devices and methods of this general type and which enables a better allowance to be made for the natural hearing perception.

With the foregoing and other objects in view there is provided, in accordance with the invention, a method of amplifying an input signal in a hearing apparatus, the method which comprises:

predefining a channel-specific compression characteristic curve in each of a plurality of spectrally-separated processing channels of the hearing apparatus, the compression characteristic curve defining a relationship between an input level and an output level in a respective processing channel of the hearing apparatus;

predefining a channel-specific input level threshold for each processing channel;

defining a respective channel-specific operating compression characteristic curve according to the predetermined channel-specific compression characteristic curve below the channel-specific input level threshold;

defining a respective curve of the channel-specific operating compression characteristic curve with a compression ratio of greater than 8 above the channel-specific input level threshold; and amplifying a respective input signal portion of the hearing apparatus in each processing channel as a function of the channel-specific operating compression characteristic curve.

In other words, the objects of the invention are achieved by a method for amplifying an input signal in a hearing apparatus by predefining a channel-specific compression characteristic curve in a number of spectrally-separated processing channels of the hearing apparatus, which defines a relationship between an input level and an output level in the respective processing channel of the hearing apparatus, and amplifying a respective input signal portion of the hearing apparatus in each processing channel as a function of a channel-specific operation compression characteristic curve, predefining a channel-specific input level threshold for each processing channel, defining the respective channel-specific operating compression characteristic curve according to the predefined channel-specific compression characteristic curve below the channel-specific input level threshold and defining a respective curve of the channel-specific operating compression characteristic curve with a compression ratio of greater than 8 above the channel-specific input level threshold.

The amplification of an input signal advantageously therefore takes place in a channel-specific manner in a number of processing channels which correspond to a frequency band respectively. Here the compression is defined in a channel-specific manner by a compression characteristic curve in each instance, which depends on the input signal and/or on the portion of the input signal in the respective channel. An amplification of the input signal therefore results, which does not depend fixedly on the output level, but instead on the nature of the input signal. A signal-specific amplification can thus be realized, which makes more allowance for the natural hearing perception.

The input level of each channel-specific input signal portion is preferably determined with a time constant which is essentially larger than 250 ms. A relatively long time constant, i.e. a slow processing, therefore exists, as a result of which signal distortions are prevented.

Furthermore, a channel-specific output level limit value can be predefined for each processing channel, wherein the respective channel-specific compression characteristic curve does not reach a fixed distance from the channel-specific output level limit value. Such a distance from a predetermined output level limit is advantageous in that the specific output level limit is also then not exceeded if the input level lies therebelow particularly during a settling time of a specific dynamic.

This fixed distance between the compression characteristic curve and the channel-specific output level limit value should amount to at least 15 dB. This is therefore favorable since speech signals average a dynamic of +/−15 dB. The distance should therefore not fall below 15 dB.

According to a further embodiment, a frequency-independent overall level of the input signal encompassing all input signal portions is measured, a point in time is determined, at which the measured overall level reaches a predefined overall level threshold value, for the point in time in each process channel at which the respective channel-specific input level threshold accordingly defines the momentary level of the respective input signal portion (as a result of which the channel-specific input level threshold is predefined) and the channel-specific operating compression characteristic curves are defined accordingly in all processing channels. This is advantageous in that with higher input levels, the level restriction does not take place in a non-specific manner in terms of signals. Instead, it is therefore defined that an input signal exists with a high overall level (broadband) and the compression and/or restriction then takes place very specifically as a function of the channel and/or frequency.

In this case the channel-specific operating compression characteristic curve can be kept unchanged as long as the measured overall level is greater than or equal to the overall level threshold value. Thus if the overall level of the input signal remains very high, a new compression characteristic curve need not be determined continuously.

Furthermore, each channel-specific operating compression characteristic curve can correspond to the respective predefined channel-specific compression characteristic curve if the measured overall value lies below the overall level threshold value. With low overall levels of the input signal, the predefined compression characteristic curve can therefore be used in the respective channel without this having to be determined as a function of the input signal and/or input signal portion.

It is furthermore favorable if in each processing channel the compression in a level interval directly below the respective channel-specific input level threshold lies close to 1. This is advantageous in terms of a natural dynamics of the output signal in the region of the frequency-dependent and/or channel-specific input level threshold.

Furthermore, a minimal level value can be predefined for each channel-specific input level threshold. This is advantageous in some instances if narrowband input signals exist. In this case, the level restriction and/or strong compression does not take place with very small input levels.

Other features which are considered as characteristic for the invention are set forth in the appended claims.

Although the invention is illustrated and described herein as embodied in a method for restricting the output level in hearing apparatuses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
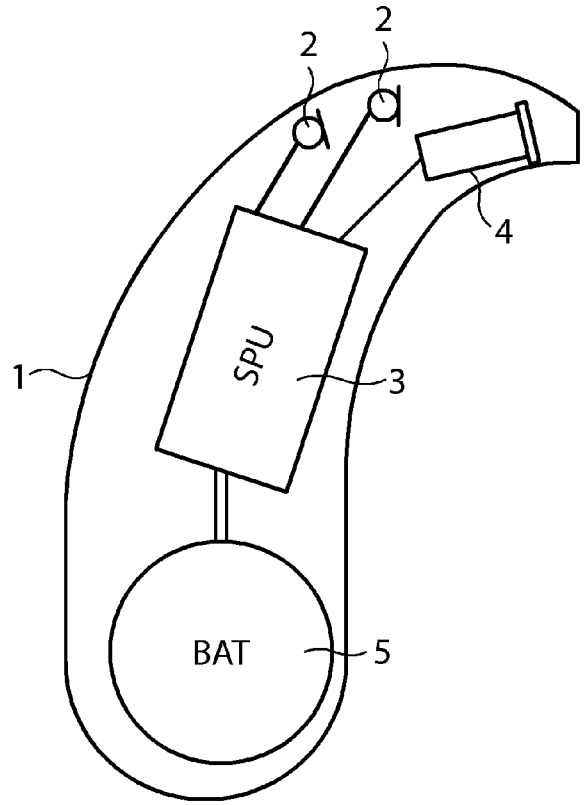
FIG 1 PRIOR ART
FIG. 1 is a schematic illustrating a layout of a hearing apparatus in the form of a BTE hearing aid according to the prior art.

An input signal in a hearing apparatus and in particular in a hearing device is typically broken down into a number of input signal portions by an analysis filter bank and the input signal portions are further processed in a number of channels in a frequency-specific manner. A specific amplification therefore takes place in each channel. The individual channels are combined in a synthesis filter bank at the end of the channel-specific processing, as a result of which a broadband output signal finally results.

The inventively proposed solution relates to an input side or input-dependent restriction of the amplification in order to reduce the distortions in the case of loud broadband input signals. Referring now once more to the figures of the drawing in detail and first, particularly, to FIG. 2 thereof, the amplification is restricted by a compression characteristic curve 10 especially for each channel. The compression characteristic curve 10 is frequency-dependent and thus channel-specific. The output level $L_A$ of the hearing apparatus results from the compression characteristic curve 10 in the input-output level diagram as a function of the input level $L_E$ at the input of the hearing apparatus.

The output level $L_A$ corresponds to the input level $L_E$ along the angle bisector 11 of the input-output level diagram. No amplification therefore takes place on the angle bisector 11 and the compression ratio amounts to 1. The vertical distance of the angle bisector 11 from the compression characteristic curve 10 corresponds to the level-specific amplification caused by the compression characteristic curve 10.

In order now to realize the input-side restriction in amplification, a frequency-dependent and/or channel-specific input level threshold $L_S$ is also predefined for each channel. Such a channel-specific input level threshold $L_S$ divides the operating compression characteristic curve 10 actually used during operation into two halves. Below the input level threshold $L_S$, the operating compression characteristic curve 10 corresponds to a predetermined compression characteristic curve. Above the input level threshold $L_S$, the operating compression characteristic curve 10 deviates from the predetermined characteristic curve 12 (dotted line in FIG. 2). It proceeds here horizontally continuously further. This corresponds to an infinitely high compression behavior. It is sufficient for the present invention for the operating compression characteristic curve to proceed above the channel-specific and/or frequency-dependent input level threshold with a very minimal gradient, namely with a compression ratio of more than 8. With a high compression ratio of the input level-related dynamic compression of this type above the (fixed) frequency-dependent input threshold $L_S$ and a slow time constant for the signal processing (substantially greater than 250 ms), compression ratios result in which the static amplification is reduced with a further increase in the input level above the input level threshold $L_S$.

Figure 2:
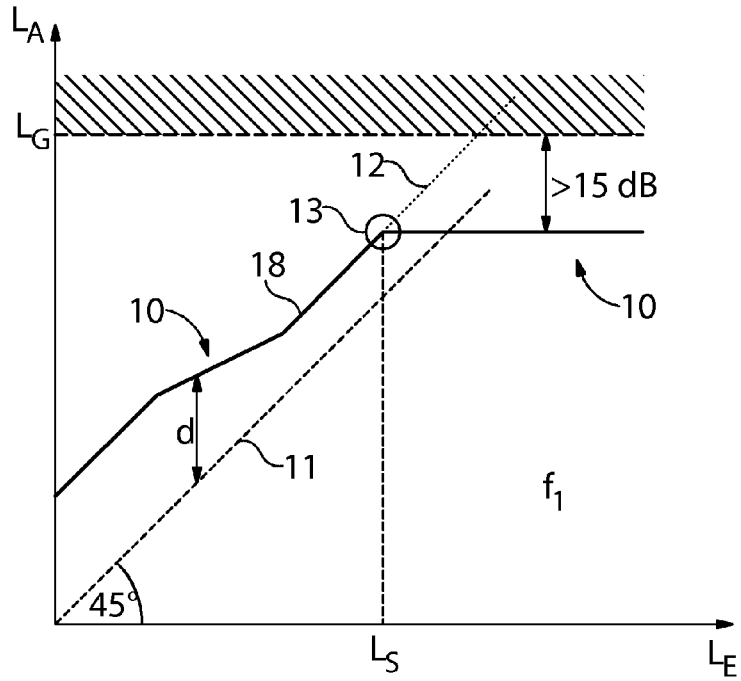
FIG. 2 is an input-output level diagram with an amplification restriction above a frequency-dependent input level threshold.

FIG. 2 furthermore shows a frequency-dependent output level limit value $L_G$. It identifies an output level which is not to be exceeded with any input level. The output sound pressure generated by the hearing apparatus and/or the hearing device is to lie according to the operating compressing characteristic curve 10 at least 15 dB below the channel-specific or frequency-dependent output level limit value $L_G$. This is due to the fact that speech averages a dynamic range of 30 dB (+/−15 dB). Since the measurement of the input level lies for instance in the range of 1 ms, the working point is only established after a specific time. In this settling time, it may result in significant distortions if the level is not restricted.

As already indicated, the vertical distance d of the operating compression characteristic curve 10 from the bisector line 11 corresponds to the actually applied amplification with the respective input level $L_E$. With low input levels, a greater amplification typically takes place than with higher input levels. With very high input levels, it is even attenuated.

The operating compression characteristic curve 10 shown in FIG. 2 is channel-specific and/or frequency-dependent and applies here to the frequency $f_1$. The respective compression characteristic curve may possess another curve for other frequencies.

The channel-specific input level threshold $L_S$ need not be fixedly set and/or predefined. Instead, it can also be calculated as a function of a broadband input sound pressure level (i.e. of the frequency-independent overall input level). To this end, the input level of the respective input signal portion is then accurately scanned for instance if the associated frequency-independent and/or broadband overall input level lies below a predefined frequency-independent level threshold (e.g. 15 dB below the output level limit threshold $L_G$). The break-point 13 of the operating compression characteristic curve 10 is dynamically determined in this way. Accordingly, the break-point 13 and/or the associated input level threshold $L_S$ may be low in some of the processing channels and higher in others.

Figure 3:
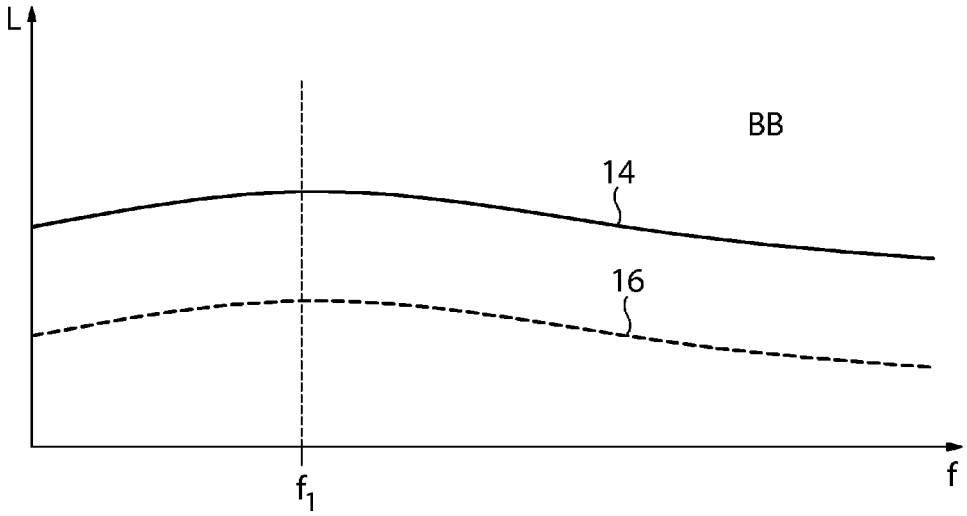
FIG. 3 is a graph showing spectral power densities at the input and output for a broadband signal.
Figure 4:
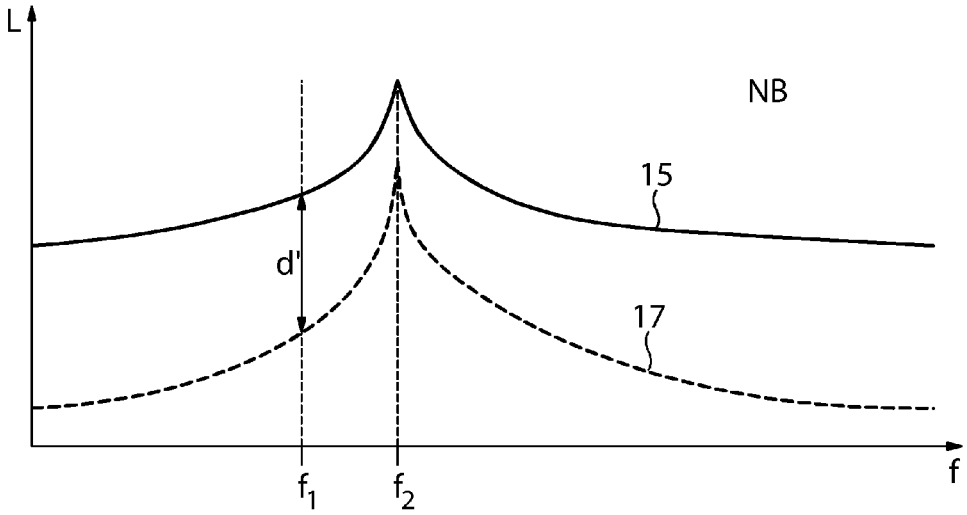
FIG. 4 is a graph showing spectral power densities at the input and output with the same broadband input level as in FIG. 3, but with a narrowband signal.

The effect of the dynamic definition of the channel-specific input level threshold $L_S$ as a function of the overall input level can be explained with the aid of FIGS. 3 and 4. FIGS. 3 and 4 each represent spectral power densities 1 at the output 14, 15 and at the input 16, 17. FIG. 3 applies to a broadband signal BB (e.g. broadband white noise), while FIG. 4 applies to a narrowband signal NB (e.g. pure tone, sinusoidal signal). Both signals have added the same broadband overall input level across all channels, i.e. the area below the dashed curve 16 corresponds to the area below the dashed curve 17. This overall input level corresponds to the total of the individual level and represents the overall energy and/or overall output of the input signal. For instance an overall input level of 90 dB is measured.

FIG. 2 may then be considered schematically as a cross-section through FIGS. 3 and 4 at a frequency $f_1$. For a specific level, the distance d' between input 17 and output 15 then results at the frequency $f_1$.

With a broadband noise according to FIG. 3, the distance between the spectral density at output 14 and at input 16 is almost constant for instance. This is because the input level $L_E$ hardly varies across the frequency so that in accordance with FIG. 2, the same amplification is almost always applied and the spectral power density at the output 14 thus also remains almost constant.

If the input signal in accordance with FIG. 4 nevertheless has a significantly higher spectral power density at a frequency $f_2$ for instance than at other frequencies, the amplification thus also changes in accordance with FIG. 2 across the frequency. Since it typically reduces at higher levels, the distance between curves 15 and 17 is less at the frequency $f_2$ than at other frequencies.

If the threshold value for the overall input level is reached in a broadband input signal BB in accordance with FIG. 3, the levels of the individual channels according to curve 16 are on an average level and a corresponding average amplification is applied in accordance with FIG. 2. The area between the curves 14 and 16 represents the increase in energy between the input signal and the output signal.

With the narrowband signal NB, the threshold value is achieved for the overall input level, if the levels around frequency $f_2$ are very high, while the levels outside of this maximum are comparatively low. Accordingly, the level maximum at the frequency $f_2$ is amplified by less than outside of this maximum at frequencies with a lower level. The overall increase in energy is produced again from the area between the curves 15 and 17. Since low levels predominantly exist with the narrowband signal, a larger amplification results across a large part of the spectrum than with the broadband signal BB, so that the area between the curves 15 and 17 is greater than the area between the curves 14 and 16. This nevertheless means that the overall input level of a narrowband signal is more amplified than the overall input level of a broadband signal. Natural hearing perception is thus used, since a narrowband signal is amplified more than a broadband signal, wherein the narrowband amplified signal is then also not perceived louder than the broadband amplified signal.

If slower compression time constants are used, negligible signal distortions thus result in the event of high compression ratios above the input level thresholds $L_S$. After the input level thresholds are exceeded, a sufficiently dimensioned distance of the resulting output level from the frequency-dependent output level limit values $L_G$ prevents a distortion of very loud speech signals. Distortions briefly result during the settling time only when considered dynamically.

The use of a frequency-independent overall input level threshold produces the input side restriction independently of the spectral distribution of the signal. Nevertheless, different frequency-dependent output level thresholds $L_S$ are determined, which are dependent on the current spectral distribution of the signal.

According to one development, only compression ratios close to 1 are used in a defined input level interval 18 directly below the frequency-dependent input level threshold L. The applied amplification factors are thus level-independent in this interval (same distance of the operating characteristic curve 10 from the perpendicular bisector 11). Furthermore, the amplification in this range should be significantly attenuated in comparison with the statically set amplification factors at very low levels. A higher output sound pressure level results overall for narrowband signals than for broadband signals, as displayed above, despite the identical broadband overall input level threshold (=overall level threshold value). The loudness of the output signals restricted thereby is thus significantly better matched to the psychoacoustic boundary conditions.

The invention claimed is:

1. A method of amplifying an input signal in a hearing apparatus, the method which comprises:

predefining a channel-specific compression characteristic curve in each of a plurality of spectrally-separated processing channels of the hearing apparatus, the compression characteristic curve defining a relationship between an input level and an output level in a respective processing channel of the hearing apparatus;

predefining a channel-specific input level threshold for each processing channel;

defining a respective channel-specific operating compression characteristic curve according to the predetermined channel-specific compression characteristic curve below the channel-specific input level threshold;

defining a respective curve of the channel-specific operating compression characteristic curve with a compression ratio of greater than 8 above the channel-specific input level threshold; and amplifying a respective input signal portion of the hearing apparatus in each processing channel as a function of the channel-specific operating compression characteristic curve.

2. The method according to claim 1, which comprises determining the input level of each channel-specific input signal portion with a time constant that is significantly greater than 250 ms.

3. The method according to claim 1, which comprises predefining a channel-specific output level limit value for each processing channel and wherein the respective channel-specific operating compression characteristic curve does not reach a fixed distance from the channel-specific output level limit value.

4. The method according to claim 3, wherein the fixed distance amounts to at least 15 dB.

5. The method according to claim 1, which comprises:

measuring a frequency-independent overall level of the input signal encompassing all input signal portions;

determining a point in time at which the measured overall level reaches a predetermined overall level threshold value, for a point in time at which the respective channel-specific input level threshold is determined in each processing channel in accordance with a momentary level of the respective input signal portion; and defining the channel-specific operating compression characteristic curves accordingly in all processing channels.

6. The method according to claim 5, which comprises maintaining the channel specific operating compression characteristic curve unchanged as long as the measured overall input level is greater than or equal to the overall level threshold value.

7. The method according to claim 5, wherein each channel-specific operating compression characteristic curve corresponds to the respectively predetermined channel-specific compression characteristic curve, if the measured overall level lies below the overall level threshold value.

8. The method according to claim 1, wherein in each processing channel the compression ratio in a level interval directly below the respective channel-specific input level threshold lies close to 1.

9. The method according to claim 1, which comprises predefining a minimal level value for each channel-specific input level threshold.

* * * * *